US006792994B2

(12) United States Patent
Lin

(10) Patent No.: US 6,792,994 B2
(45) Date of Patent: Sep. 21, 2004

(54) DOUBLE-LAYER DRAPE

(76) Inventor: Henry Lin, 2F, No. 223, Chungyang Rd., Nankang District, Taipei (TW)

( * ) Notice: Subject to any disclaimer, the term of this patent is extended or adjusted under 35 U.S.C. 154(b) by 0 days.

(21) Appl. No.: 10/277,675

(22) Filed: Oct. 23, 2002

(65) Prior Publication Data

US 2004/0079492 A1 Apr. 29, 2004

(51) Int. Cl.[7] ..... A47H 5/00
(52) U.S. Cl. ..... 160/84.03; 160/89
(58) Field of Search ..... 160/84.01, 84.03, 160/89, 330, 348, 113, 168.1 R, 176.1 R, 179, 237

(56) References Cited

U.S. PATENT DOCUMENTS 5,787,951 A * 8/1998 Tonomura et al. ..... 160/84.01
6,142,210 A * 11/2000 Isoda ..... 160/124
6,354,353 B1 * 3/2002 Green et al. ..... 160/84.04
6,431,245 B1 * 8/2002 Shen ..... 160/84.03
6,530,413 B2 * 3/2003 Hwang ..... 160/84.03
6,591,887 B1 * 7/2003 Hsu ..... 160/84.03

* cited by examiner

*Primary Examiner*—Blair M. Johnson
(74) *Attorney, Agent, or Firm*—Troxell Law Office PLLC

(57) ABSTRACT

A double-layer drape includes an upper beam and a window curtain connected to the upper beam. The window curtain includes an inner layer and an outward layer. Both layers are formed with different shade cloths. The outward layer is a pervious-to-light curtain. The inner layer includes a plurality of opaque curtains. The inner layer curtains are connected to the pervious-to-light curtain by up-and-down overlapping. In addition, the opaque curtains are simultaneously folded upwards or hung over downwards through pulling operating cords by a user to achieve the indoor anti-dazzling or semi-opaque effects.

5 Claims, 7 Drawing Sheets

DOUBLE-LAYER DRAPE

BACKGROUND OF THE INVENTION (A) Field of Invention

The invention relates to a double-layer drape, especially a double-layer drape having both inner and outer layers of shade curtains. The outward layer is a pervious-to-light curtain; and the inner layer includes a plurality of opaque curtains. The inner layer curtains are connected to the pervious-to-light curtain by up-and-down overlapping, in addition, the opaque curtains can be simultaneously folded upwards or hung over downwards through pulling operating cords by a user to achieve the indoor anti-dazzling or semi-opaque effects.

(B) Description of Prior Art

Window curtains in modem living houses mainly provide the functions of sunshade and privacy protection. FIG. 1 shows a prior art window curtain 10 (roman shade) which comprises an upper beam 11 and a window curtain cloth 12 to be connected the bottom of the upper beam 11. One end of the upper beam 11 has an operating cord brake component 13, which allows an operating cord 14 to be pierced through dropping at one side of the window curtain cloth 12 for a user to pull the cord. The window curtain cloth 12 has several equidistant horizontal shade cloths 15, which are sewed and connected to one another. Each sewed shade cloth 15 has two holes 16 for enabling the operating cord 14 to pierce through to the lowest hole 16 to be fixed, therefore, through pulling the operating cord 14 by a user, the window curtain cloth 12 can be folded upwards or hung over downwards.

Hence, the window curtain cloth 12 provides the anti-dazzling function while being dropped; on the contrary, the window curtain cloth 12 has to be folded upwards when it requires the room to be lit up by shining the light through in the room. The kind of traditional unchangeable way of drape is no more fit in with the modern life function and requirement.

In view of the foregoing drawback of conventional draper, the present Invention mainly aims at providing a double-layer drape, which including an upper beam and a window curtain to be connected with the upper beam. The window curtain is formed by two kinds of curtain cloths forming inner and outer layers. The outward layer is a pervious-to-light curtain; whereas the inner layer includes a plurality of opaque curtains. The inner layer curtains are connected to the pervious-to-light curtain by up-and-down overlapping, in addition, the opaque curtains can be simultaneously folded upwards or hung over downwards through pulling operating cords by a user to achieve the indoor anti-dazzling or semi-opaque effects. The window curtain provides two different window curtain effects at one time for meeting the requirements of modem life functions; thereby offering a variation in the fields of both operation and light control.

Another object of the invention is to provide a pervious-to-light curtain of the double-layer drape that can be pulled by a set of operating cord to enable the pervious-to-light curtain to be folded upwards or dropped downward to generate a completely well-lit effect in the room.

To enable a further understanding of the objective, structural features and function of the present invention, the detailed descriptions of the preferred embodiments are followed by the brief descriptions of the drawings below. However, it is to be understood that the disclosed embodiments are merely exemplary of the invention that may be embodied in various forms.

DETAILED DESCRIPTION OF THE PREFERRED EMBODIMENTS

Figure 1:
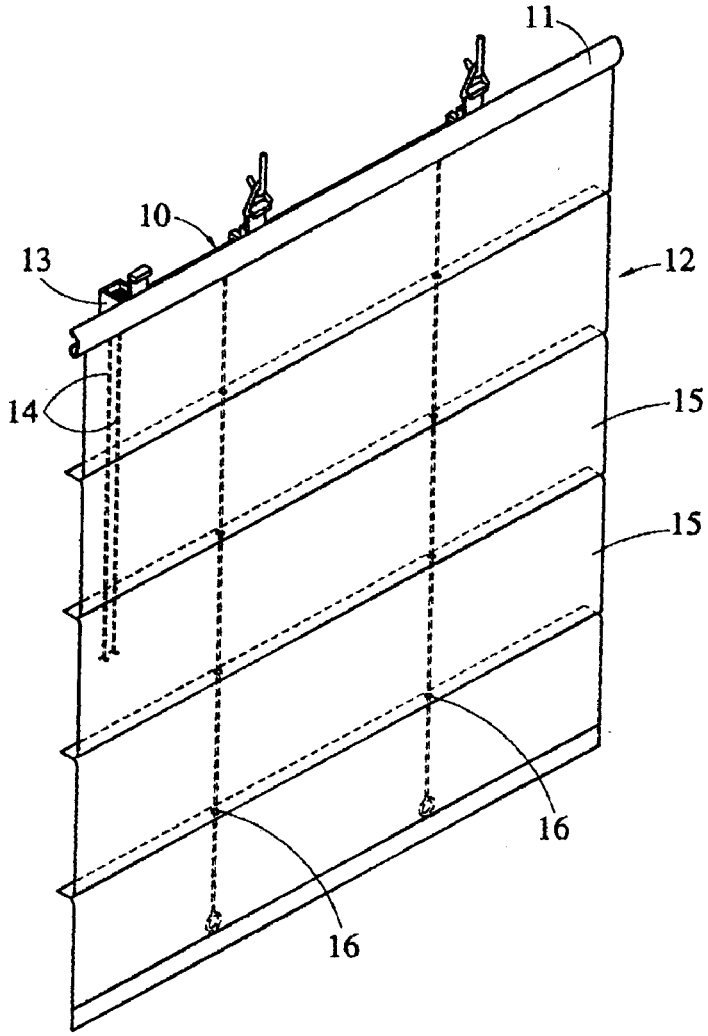
FIG.1 PRIOR ART
FIG. 1 is a perspective view of a conventional window curtain (roman shade).

With reference to FIGS. 2–7, the double-layer drape 20 of the invention comprises an upper beam 21 and a window curtain 30 to be connected to the upper beam 21. There are two sets of operating cord brake components 25 set inside the upper beam 21 to allow two operating cords 22 and 23, which have respective functions, to be pierced through within. In addition, one end of both operating cords 22 and 23 are hanging over outside the two operating cord brake components 25, respectively for a user to pull the operating cords 22 and 23. Seeing that the operating cords 22 and 23 are controlled by the operating cord brake component 25, therefore, the length of stretching the window curtain 30 can be folded upwards or dropped downwards. The other end of the operating cord 23 is a beaded device 24.

The window curtain 30 is formed by two kinds of curtain cloths of both inner and outer layers. The outward layer is a pervious-to-light curtain 31 (e.g., lace curtain); whereas the inner layer 32, which comprises a plurality of opaque curtains, Is connected to the pervious-to-light curtain 31 by up-and-down overlapping. In addition, the other ends of the operating cord 22 and the beaded device 24 are situated in-between the pervious-to-light curtains 31 and the inner layer 32. The pervious-to-light curtain 31 with the shape of rectangle is connected the base of the upper beam 21. The top of opaque curtain 32 attaches to or separates from the upper beam 21 through a self-attached mechanism 40; other equidistant opaque curtains 32, of which each base is movable, are sewed and connected to the pervious-to-light curtain 31. The self-attached mechanism 40 comprises a hook silk layer 41 integrating with the upper beam 21, besides, a nap layer 42 integrating with the top of the opaque curtain 32.

Figure 4:
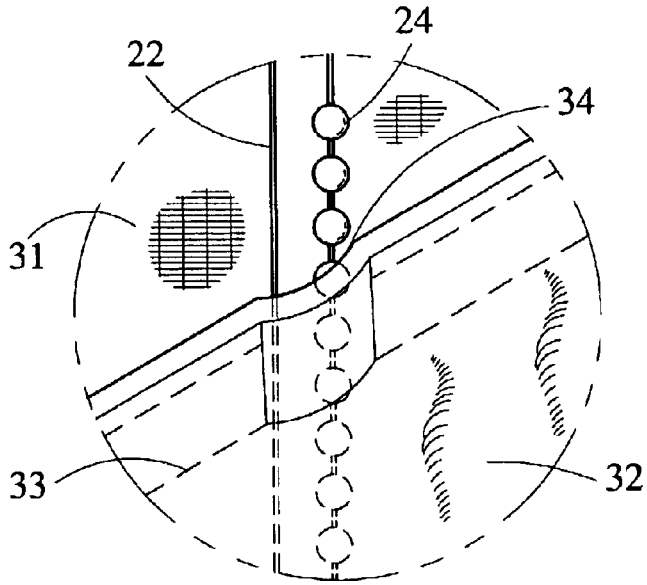
FIG. 4 is a fragmentary view enlarged taken at Area A of FIG. 3.

The sewing lines 33 connecting the pervious-to-light curtain 31 and the opaque curtain 32 form two holes 34 (as shown in FIG. 4), which allow the operating cords 22 and 23 to pierce through for forming the connection relationships with the pervious-to-light curtain 31 and the opaque curtain 32, respectively.

Figure 5:
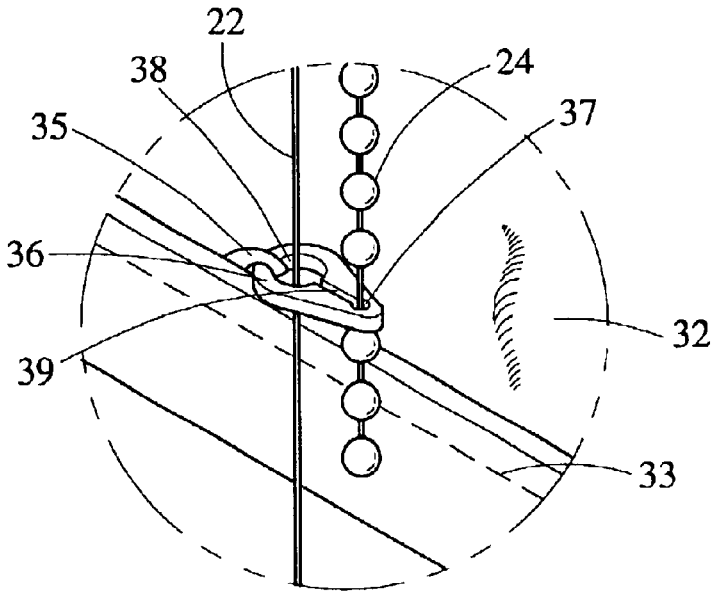
FIG. 5 is a fragmentary view enlarged taken at Area B of FIG. 3.
Figure 6:
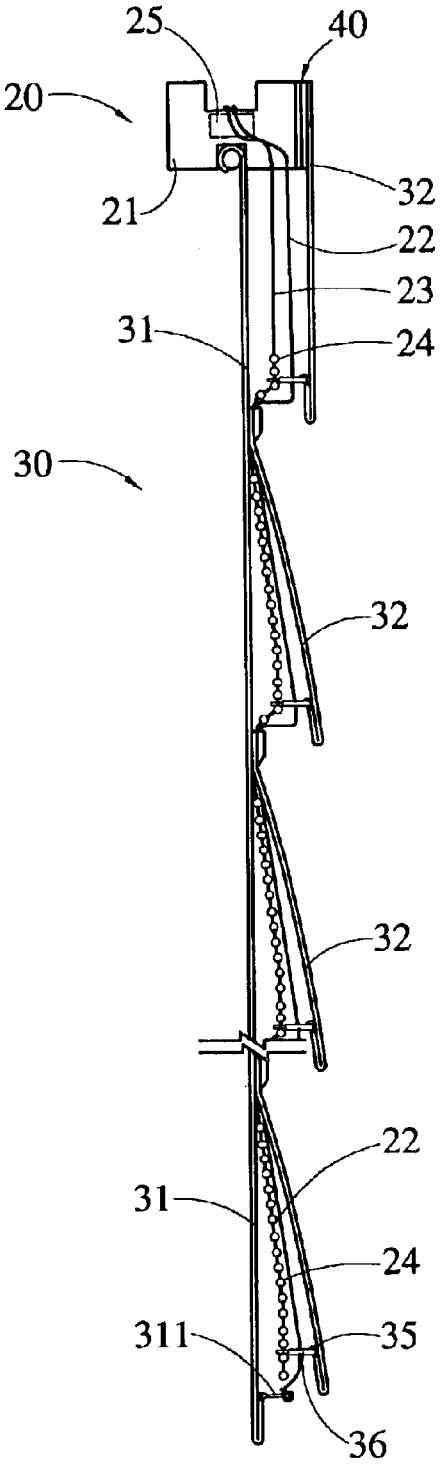
FIG. 6 is a sectional view of the invention of FIG. 2.

The base of the opaque curtain 32 forms two connected cloths 35 (as shown in FIG. 5), which link to an attached ring 36, which comprises a small hole 37 and a bigger hole 38. There is a notch 39 set in between the small hole 37 and the bigger hole 38. A beaded device 24 of the operating rod 23, which is placed from a bigger hole 38 into a small hole 37 to be positioned through the notch 39, is utilized for fixing the plurality of equidistant opaque curtains 32 on the pervious-to-light curtain 31; the end of the beaded device 24 is fixed in an attached ring 36 of the lowest opaque curtain 32; in addition, the bigger hole 38 enables the operating cord 22 to pierce through, the end of the operating cord 22 is fixed in an attached ring 311 at the base of the pervious-to-light curtain 31. Therefore, both pervious-to-light curtain 31 and the opaque curtains 32 are controlled by the operating cords 22 and 23 to be pulled upwards or downwards.

Figure 2:
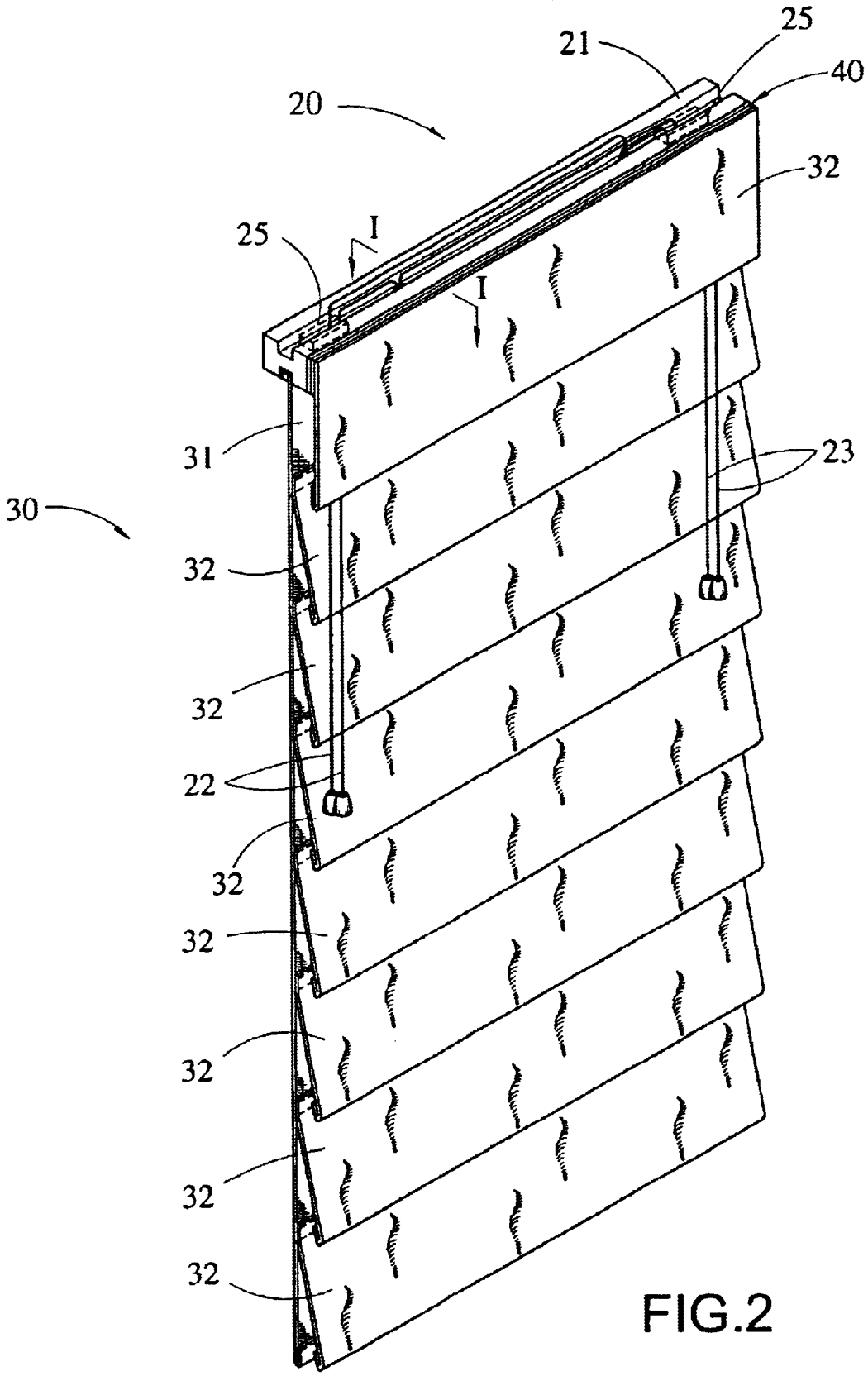
FIG. 2 is a perspective view of the invention.
Figure 3:
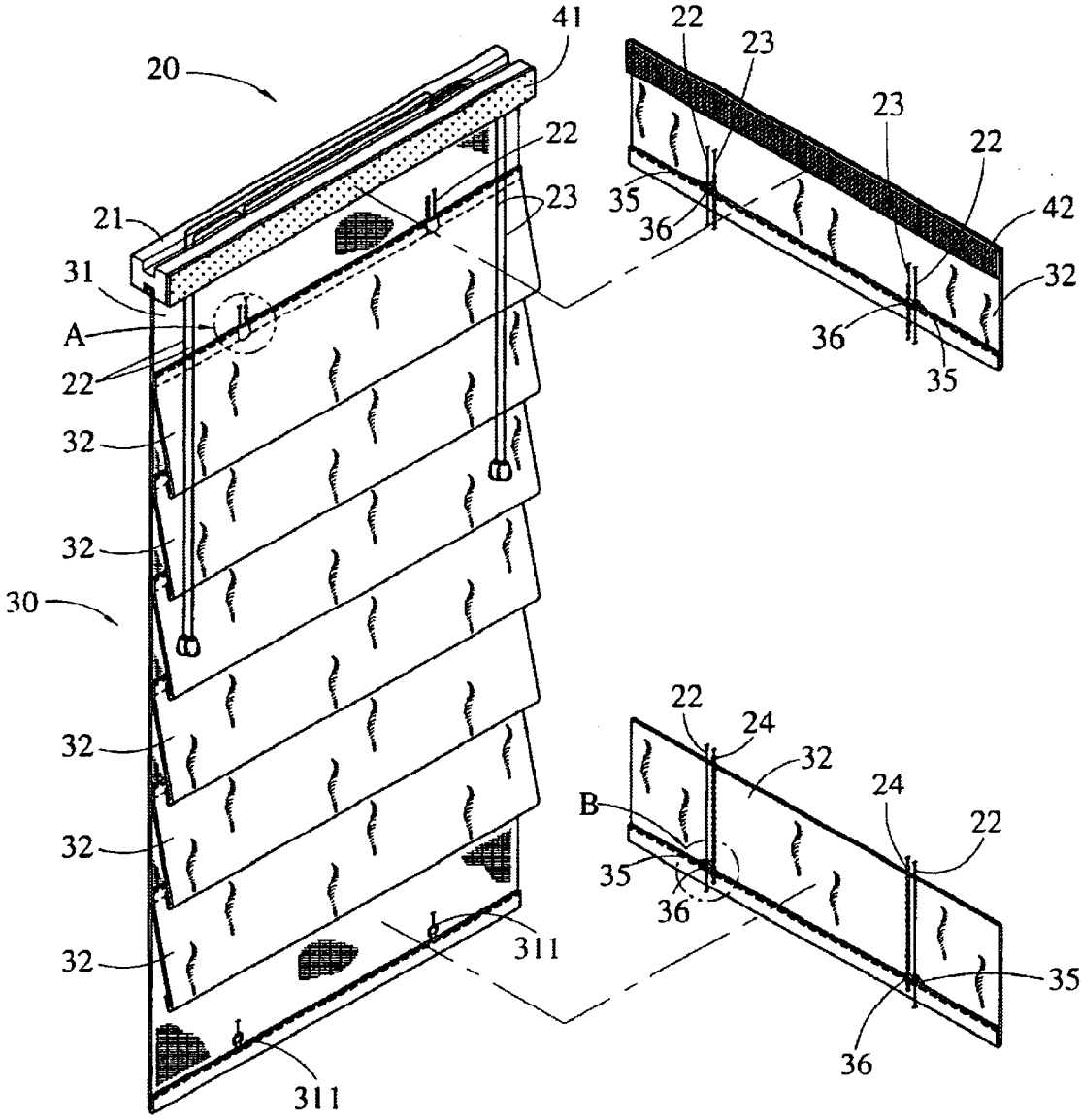
FIG. 3 is a partial perspective view of the invention.
Figure 7:
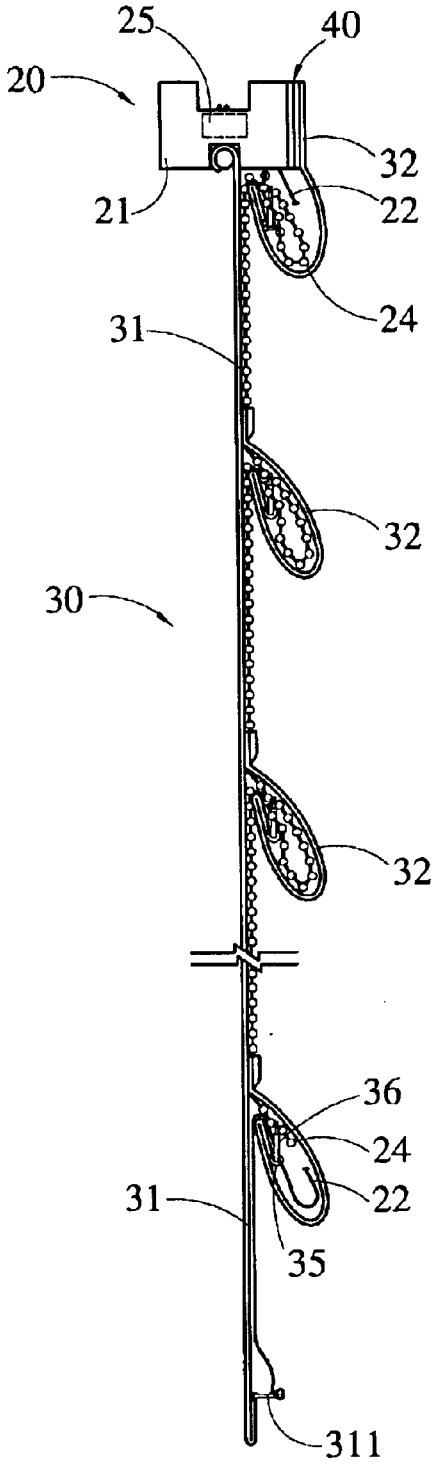
FIG. 7 is a sectional view of the upwardly folded opaque curtain according to FIG. 6.
Figure 8:
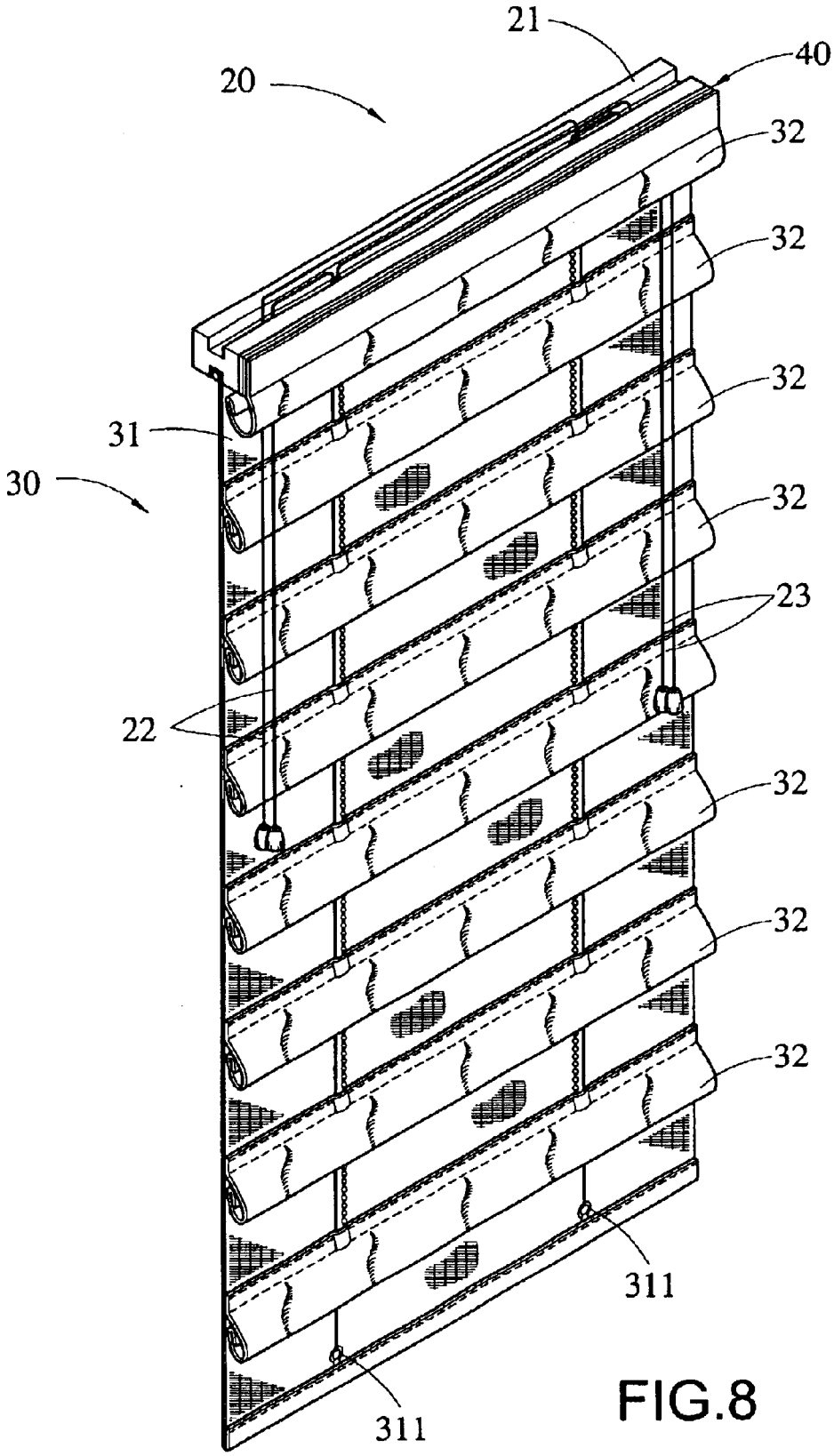
FIG. 8 is a perspective view of the upwardly folded opaque curtain according to FIG. 2.

It is as shown in FIG. 8 that the base of each opaque curtain 32 is inwardly lifted following the upward movement of the beaded device 24 when the operating cord 23 is pulled downwards. Not until being pulled to an appropriate position, the operating cord 23 is then positioned by the control of the operating cord brake component. The upward movement of each opaque curtain 32 is in between the positions as shown in FIGS. 2 and 7. The invention, therefore, enables the function of semi-opaque effect in the room.

The invention enables the operating cord 23 to be an unrestrained status for moving up and down, when a swing force is exerted on the operating cord 23, hence, when the operating cord 23 is released, and the base of each opaque curtain 32 hangs over following the beaded device 24 downwards. The invention, therefore, enables the function of anti-dazzling effect inside the room; the movement is in between the positions as shown in FIGS. 8 and 2.

Figure 9:
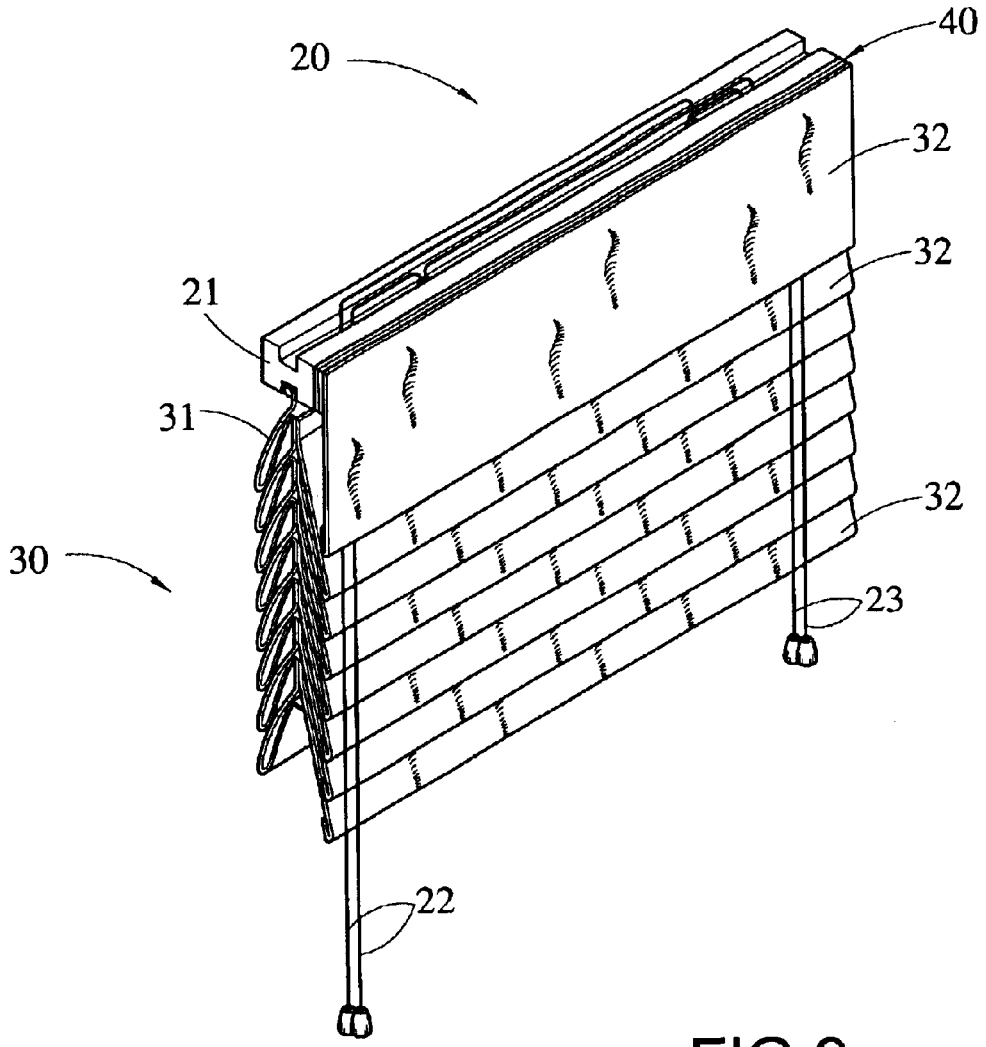
FIG. 9 is a perspective view of the upwardly folded opaque curtain according to FIG. 2.

When the operating cord 22 is pulled, window curtain 30 can be folded upwards or dropped downwards; therefore, pulling the operating cord 22 upward enables the window curtain 30 to be folded in-between the positions as shown in FIGS. 2 and 9. At this time, the pervious-to-light curtain 31 and the opaque curtains 32 are folded upwards to enable the light to shine through in the room forming a completely well-lit effect.

In short, the window curtain 30 of the invention is made of two kinds of materials forming an Inner layer and an outer layer. The outer layer is a pervious-to-light curtain 31; whereas the inner layer comprises a plurality of opaque curtains 32 overlapping up-and-down to be connected to the pervious-to-light curtain 31. The base of each opaque curtain 32 is a moveable part, which can be folded upwards or dropped downwards through pulling the operating cord 23 by a user; therefore, when the operating cord 23 is pulled downwards, the plurality of opaque curtains 32 can be lifted and folded upwards to enable the light to shine through in the room with the anti-dazzling effect. The invention enables the operating cord 23 to be an unrestrained status for moving up and down, when a swing force is exerted on the operating cord 23, so that the plurality of opaque curtains 32 hangs over by the gravity itself; the invention, therefore, enables the function of anti-dazzling effect inside the room. In addition, the pervious-to-light curtain 31 can be folded upwards or dropped downwards through pulling the operating cord 22 by a user; therefore, when the operating cord 22 is pulled downwards, the pervious-to-light curtain 31 and the opaque curtains 32 are simultaneously folded upwards to enable the light to shine through in the room generating the completely well-lit effect. The window curtain 30, therefore, provides different two window curtain effects at one time for meeting the requirements of modem life functions; the draper of the invention offers the enrichment a variation in the fields of both operation and light control.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A double-layer drape comprising:

an upper beam having at least two operating cord brake component each having at least one set of operating cords piercing therethrough to enable one end of each of the plurality of operating cords to hang over an outside of the operating cord brake component; and a window curtain having a pervious-to-light curtain forming an outer layer and a plurality of opaque curtains forming an inner layer, the outer layer being connected to the upper beam; each of the plurality of opaque curtains being movably connected by sewing lines at a top thereof to the pervious-to-light curtain and overlapped, wherein each of the plurality of opaque curtains is movable between open and closed positions by pulling one set of the operating cords, further comprising at least one hole formed between the pervious-to-light curtain and each of the plurality of opaque curtains by gaps in the sewing lines, at least two sets of the operating cords have individual functions and are inserted through each of the at least two holes and connected to the pervious-to-light curtain and the plurality of opaque curtains, respectively.

2. A double-layer drape comprising:

an upper beam having at least two operating cord brake component each having at least one set of operating cords piercing therethrough to enable one end of each of the plurality of operating cords to hang over an outside of the operating cord brake component; and a window curtain having a pervious-to-light curtain forming an outer layer and a plurality of opaque curtains forming an inner layer, the outer layer being connected to the upper beam; each of the plurality of opaque curtains being movably connected at a top thereof to the pervious-to-light curtain and overlapped, wherein each of the plurality of opaque curtains is movable between open and closed positions by pulling one set of the operating cords, further comprising a plurality of attached rings, at least one attached ring is connected to a bottom of each of the plurality of opaque curtains, each of the plurality of attached rings includes a large hole and a small hole, a first set of the cords movably inserted through the large hole of each of the plurality of attached rings and a second set of cords is inserted through and fixed relative to the small hole of each of the plurality of attached rings, at least tow sets of the operating cords have individual functions.

3. The double-layer drape according to claim 2, wherein a first end of the first set of cords is connected to a bottom of the pervious-to-light curtain, wherein the pervious-to-light curtain is movable between open and closed positions by pulling a second end of the first set of cords.

4. The double-layer drape in accordance with claim 2, wherein the second set of cords is a beaded device, the second set of cords is connected to the small hole of each of the plurality of attached rings, wherein the plurality of opaque curtains are movable between open and closed positions by pulling the second set of cords which is equipped in the small hole of the rings.

5. The double-layer drape in accordance with claim 4, wherein the large hole and the small hole of each of the plurality of attached rings have a notch therebetween; the notch enables the beaded device of the operating cord to slip from the bigger hole into the small hole to be equidistantly positioned between the plurality of attached rings.

* * * * *